US008905631B2

(12) United States Patent
Sakurazawa et al.

(10) Patent No.: US 8,905,631 B2
(45) Date of Patent: Dec. 9, 2014

(54) SWITCH DEVICE AND TIMEPIECE INCLUDING SWITCH DEVICE

(71) Applicant: Casio Computer Co., Ltd., Shibuya-ku, Tokyo (JP)

(72) Inventors: Naohiko Sakurazawa, Akishima (JP); Hiroki Imai, Yachiyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/199,843

(22) Filed: Mar. 6, 2014

(65) Prior Publication Data

US 2014/0286146 A1 Sep. 25, 2014

(30) Foreign Application Priority Data

Mar. 21, 2013 (JP) ..... 2013-058455

(51) Int. Cl.
*G04B 29/00* (2006.01)
*G04B 3/04* (2006.01)

(52) U.S. Cl.
CPC ..... *G04B 3/043* (2013.01)
USPC ..... 368/319; 368/308

(58) Field of Classification Search
USPC ..... 368/288, 306, 308, 319–321
See application file for complete search history.

(56) References Cited

U.S. PATENT DOCUMENTS

| | | | | | |
|---|---|---|---|---|---|
| 398,957 | A | * | 3/1889 | Paxon | 368/306 |
| 2,218,889 | A | * | 10/1940 | Marti | 368/288 |
| 2,465,571 | A | * | 3/1949 | Boninchi | 368/288 |
| 2,482,317 | A | * | 9/1949 | Borer | 368/288 |
| 3,517,501 | A | * | 6/1970 | Klingenberg | 368/288 |
| 6,137,750 | A | * | 10/2000 | Rieben | 368/290 |
| 7,255,473 | B2 | | 8/2007 | Hiranuma et al. | |
| 8,740,451 | B2 | * | 6/2014 | Gourdin | 368/308 |

FOREIGN PATENT DOCUMENTS

JP 2006-194834 A 7/2006

* cited by examiner

*Primary Examiner* — Sean Kayes
(74) *Attorney, Agent, or Firm* — Holtz, Holtz, Goodman & Chick PC

(57) ABSTRACT

A switch device of the present invention includes a cylindrical member fitted into a through hole of a wristwatch case, an operating member having an operation shaft section to be inserted into the cylindrical member and an operation head section, and a lock member fixed inside the operation head section. The cylindrical member includes engaging projections, and the lock member includes resilient support sections which have a space with respect to the inner circumferential surface of the operation head section and are resiliently deformed in a radial direction, and lock sections with which the engaging projections are resiliently engaged. Accordingly, when the operating member is pushed inward and rotated, the engaging projections resiliently deform the resilient support sections and are engaged with the lock sections. Also, only by the operating member being rotated against the regulating force of the lock section, the lock sections are disengaged from the engaging projections.

7 Claims, 15 Drawing Sheets

SWITCH DEVICE AND TIMEPIECE INCLUDING SWITCH DEVICE

CROSS-REFERENCE TO RELATED APPLICATION

This application is based upon and claims the benefit of priority from the prior Japanese Patent Application No. 2013-058455, filed Mar. 21, 2013, the entire contents of which is incorporated herein by reference.

BACKGROUND OF THE INVENTION

1. Field of the Invention

The present invention relates to a switch device for use in a timepiece such as a wristwatch, and a timepiece including the switch device.

2. Description of the Related Art

For example, a wristwatch is known which includes a switch device where an operating member such as a crown has been provided in a wristwatch case such that it can be pulled outward, as described in Japanese Patent Application Laid-Open (Kokai) Publication No. 2006-194834.

This type of switch device is structured such that the time can be adjusted by the operating member, which is protruding from the wristwatch case, being pulled outward and rotated in this state.

In this structure of the switch device, a winding stem pipe is fitted into a through hole of the wristwatch case, a shaft section of the operating member is inserted into the winding stem pipe, and the outer end of a winding stem is mounted on the shaft section of the operating member, whereby the winding stem slides and rotates in accordance with the operation of the outer end of the operating member.

In this case, a ring member having a plurality of engaging projections is mounted on the operating member.

Also, the winding stem pipe has a small-diameter section that is fitted into the through hole of the wristwatch case and a large-diameter section that protrudes outside of the wristwatch case. On the outer circumferential surface of the large-diameter section, a plurality of engaging grooves are provided which engageably lock the engaging projections of the ring member.

These engaging grooves each include a guide groove for attachment and detachment which attachably and detachably guides an engaging projection of the ring member in the axial direction of the winding stem pipe, a lock groove which restricts the movement of the engaging projection of the ring member in the axial direction to lock the engaging projection, and a communication groove which guides the engaging projection of the ring member to one of the guide groove and the lock groove.

As a result, in the switch device, when the operating member is to be locked, the engaging projection of the ring member is inserted and pushed into the guide grove. Then, when the operating member in this state is rotated, the engaging projection of the ring member is moved to the lock groove via the communication groove, whereby the movement thereof in the axial direction of the winding stem pipe is restricted, and the operating member is locked in a state of being pushed in.

Also, in the switch device, when the lock on the operating member is to be released, the operating member is rotated while being pushed inward. As a result, the engaging projection of the ring member positioned in the lock groove is moved from the lock groove to the guide groove via the communication groove, whereby the lock on the engaging projection by the lock groove is released. In this state, when the engaging projection of the ring member is moved in the axial direction to be detached from the guide groove, the operating member is pulled outward, whereby the time can be adjusted.

However, in this switch device, when the lock on the operating member is to be released, the engaging projection of the ring member positioned in the lock groove cannot be detached from the lock groove unless the operating member is rotated while being pushed inward. Therefore, the operability of the operating member is deficient. Also, when the operating member is in the locked state, if the outer end thereof hits some object and is inadvertently rotated, the lock on the operating member is released, which may cause an erroneous operation.

SUMMARY OF THE INVENTION

An object of the present invention is to provide a switch device by which an unlock operation can be easily performed and inadvertent rotation of an operating member in a locked state can be prevented, and a timepiece including the switch device.

In order to achieve the above-described object, in accordance with one aspect of the present invention, there is provided a switch device comprising: a case having a through hole; a cylindrical member fitted into the through hole of the case; an operating member having a shaft section to be inserted into the cylindrical member and an operating section on an outer end; and a lock member which is fixed inside the operating section of the operating member and slides and rotates together with the operating section along outer circumference of the cylindrical member, wherein the cylindrical member is provided with an engaging projection projecting toward inner circumferential surface of the lock member, and wherein the lock member includes an resilient support section which has a space with respect to inner circumferential surface of the operating section and are resiliently deformed in a radial direction, and a lock section which is provided to the resilient support section and with which the engaging projection is resiliently engaged when the operating section is pushed inward and rotated.

In accordance with another aspect of the present invention, there is provided a timepiece comprising: a timepiece module; a timepiece case in which the timepiece module has been arranged; and a switch device placed in the timepiece case for operating the timepiece module, wherein the switch device includes a case having a through hole, a cylindrical member fitted into the through hole of the case, an operating member having a shaft section to be inserted into the cylindrical member and an operating section on an outer end, and a lock member which is fixed inside the operating section of the operating member and slides and rotates together with the operating section along outer circumference of the cylindrical member, wherein the cylindrical member is provided with an engaging projection projecting toward inner circumferential surface of the lock member, and wherein the lock member includes an resilient support section which has a space with respect to inner circumferential surface of the operating section and are resiliently deformed in a radial direction, and a lock section which is provided to the resilient support section and with which the engaging projection is resiliently engaged when the operating section is pushed inward and rotated.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 5A and FIG. 5B are diagrams depicting the cylindrical member in FIG. 4, of which FIG. 5A is an enlarged side view and FIG. 5B is an enlarged sectional view;

DETAILED DESCRIPTION OF THE PREFERRED EMBODIMENTS

First Embodiment

A first embodiment in which a switch device of the present invention has been applied in a wristwatch is described below with reference to FIG. 1 to FIG. 10.

Figure 1:
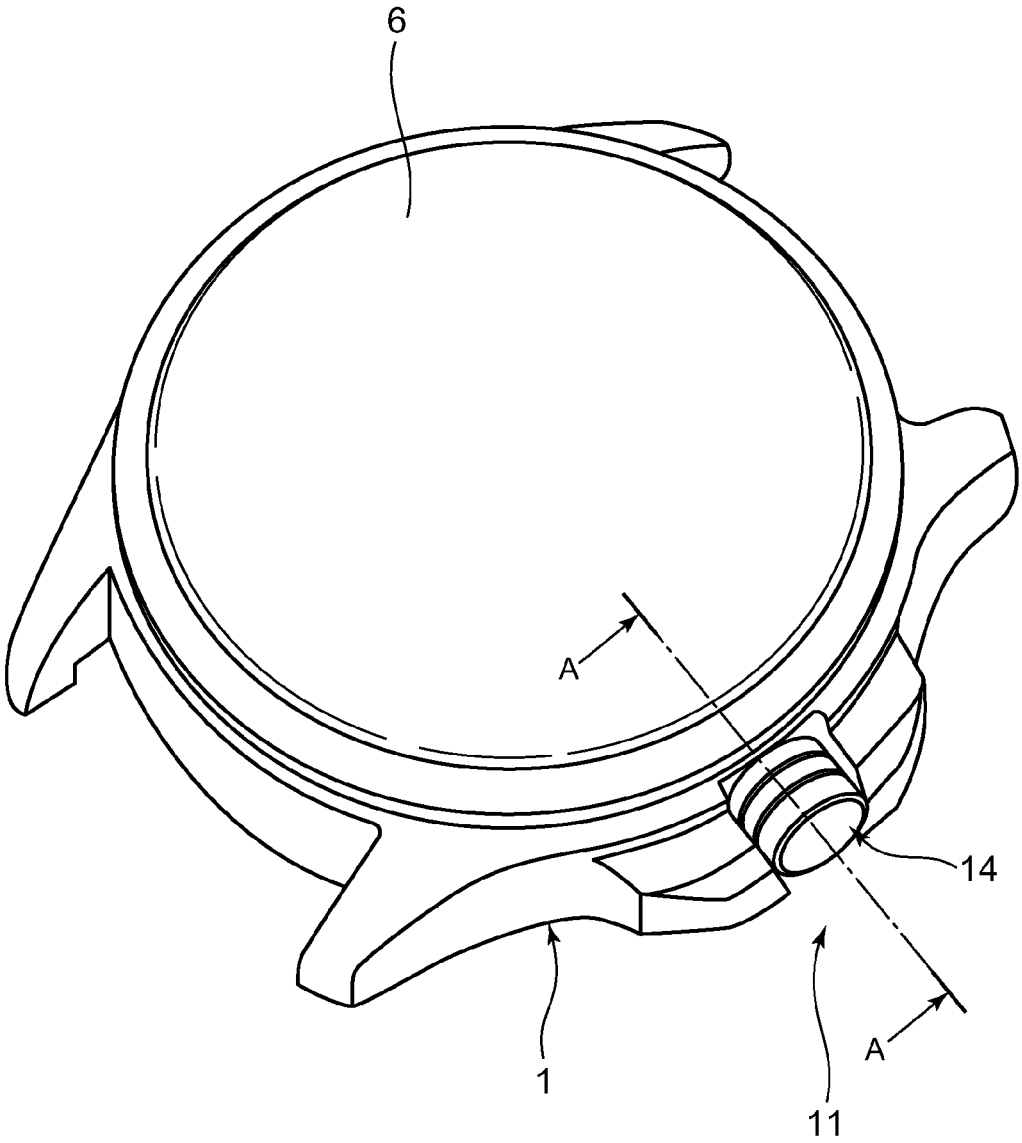
FIG. 1 is an enlarged perspective view of a first embodiment in which a switch device of the present invention has been applied in a wristwatch.
Figure 2:
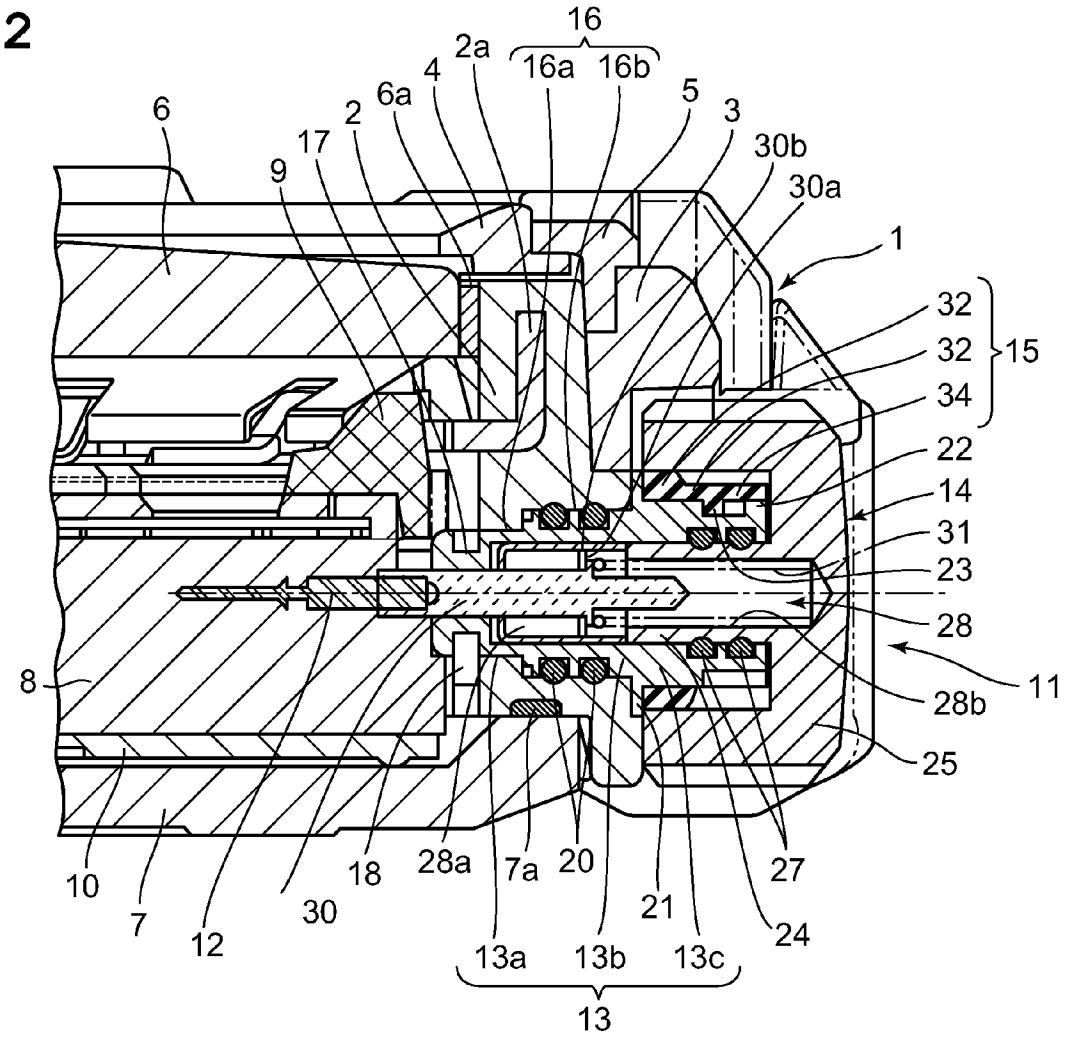
FIG. 2 is an enlarged sectional view of the main section of the wristwatch taken along line A-A in FIG. 1.
Figure 3:
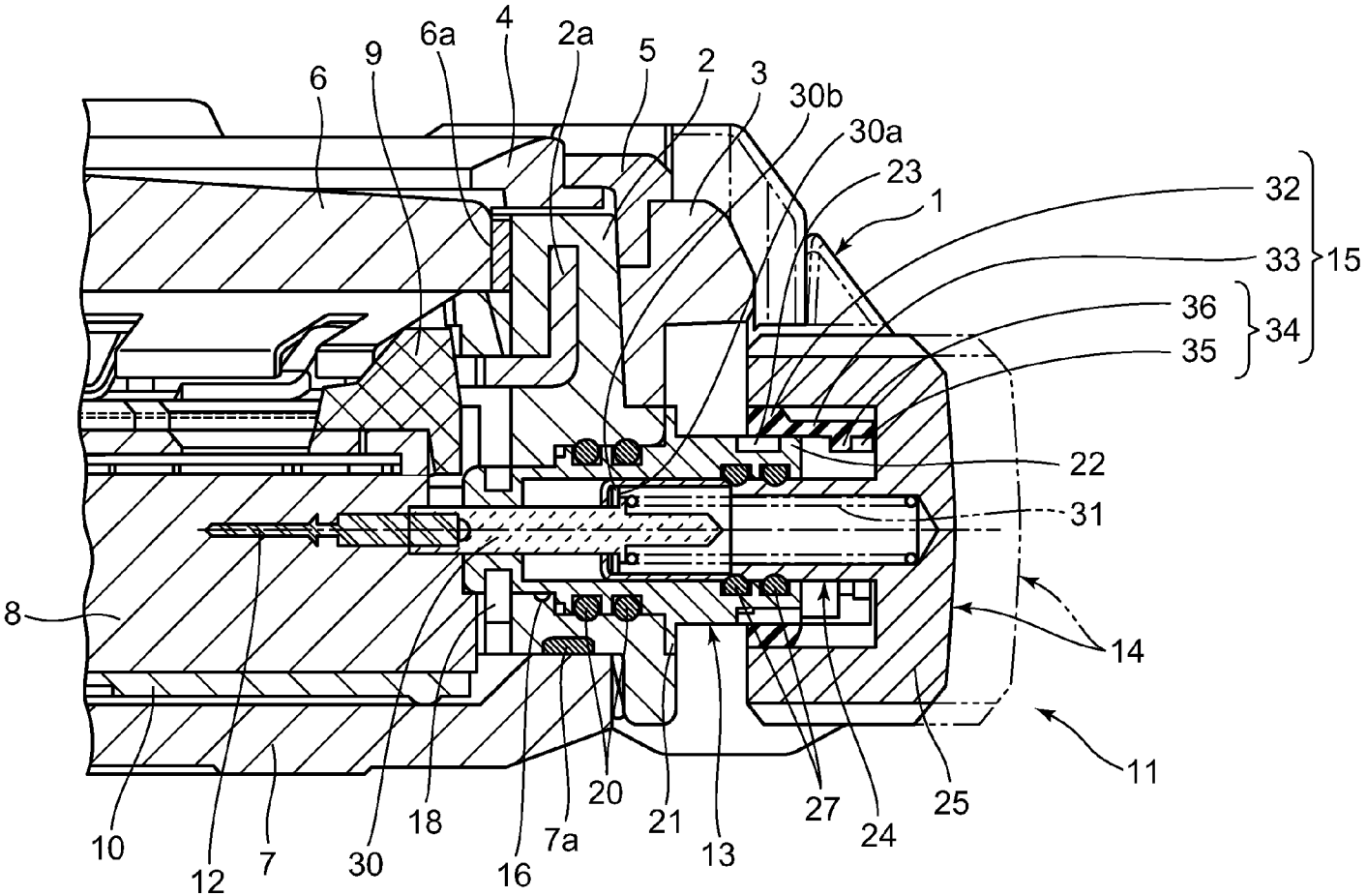
FIG. 3 is an enlarged sectional view of the main section, in which locking by a lock member has been released in the switch device depicted in FIG. 2, and whereby an operating member has been pulled outward.

This wristwatch includes a wristwatch case 1, as depicted in FIG. 1 to FIG. 3. The wristwatch case 1 includes a case body 2, a bezel 3, and a decorative panel 4.

The case body 2 is made of synthetic resin, and has provided therein a reinforcing member 2*a* made of metal, as depicted in FIG. 2 and FIG. 3.

The bezel 3 is made of synthetic resin such as urethane resin, and provided on the outer circumferential surface of the case body 2. The decorative panel 4 is made of a metal plate, and mounted on the upper surface of the case body 2 by a pressure ring 5.

In an opening in the upper portion of the case body 2 of the wristwatch case 1, a timepiece glass 6 is attached via a gasket 6*a*, as depicted in FIG. 2 and FIG. 3.

On the lower portion of the case body 2 of the wristwatch case 1, a rear lid 7 is mounted via a waterproof ring 7*a*.

Inside the wristwatch case 1, a timepiece module 8 is provided with it being pressed by a parting plate 9 and a pressure ring 10.

The timepiece module 8 includes various components (not depicted) required for a timepiece.

On a side portion on the three o'clock side of the wristwatch case 1, a switch device 11 is provided, as depicted in FIG. 1 to FIG. 3.

The switch device 11 is to, for example, switch modes of the timepiece module 8 or correct the time, and includes a winding stem 12, a cylindrical member 13, an operating member 14, and a lock member 15.

In this case, on the side portion on the three o'clock side of the wristwatch case 1, a through hole 16 penetrating from inside to outside of the wristwatch case 1 is provided, as depicted in FIG. 2 and FIG. 3.

The through hole 16 has a rectangular-shaped small-diameter hole section 16*a* positioned inside the wristwatch case 1 and a circular-shaped large-diameter hole section 16*b* positioned outside the wristwatch case 1, and the entire through hole 16 is formed in a stepwise shape.

In the through hole 16, the cylindrical member 13 of the switch device 11 is fitted.

Figure 4:
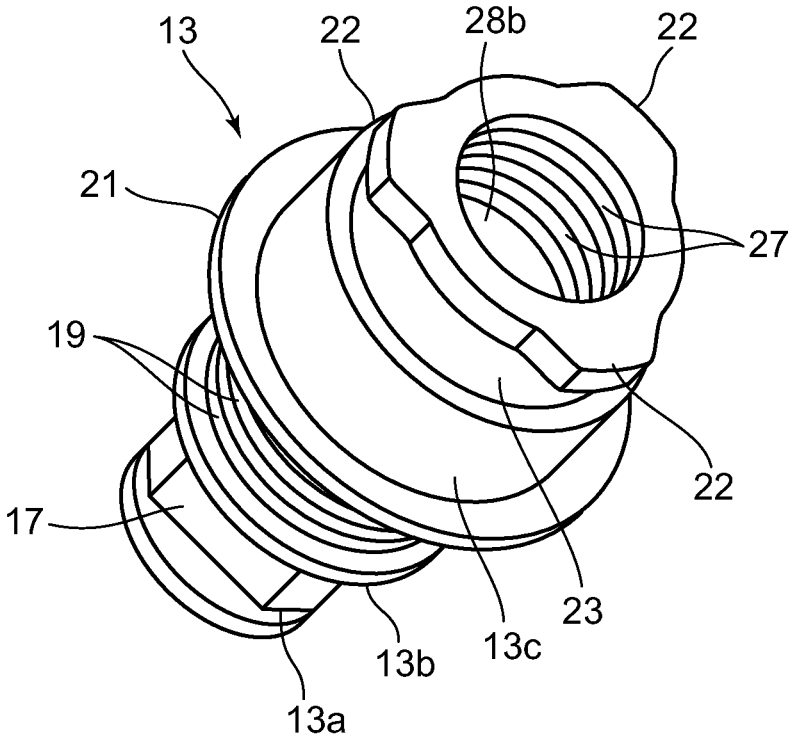
FIG. 4 is an enlarged perspective view depicting a cylindrical member of the switch device in FIG. 2.

The cylindrical member 13 includes a small-diameter cylindrical section 13*a* that is fitted into the small-diameter hole section 16*a* of the through hole 16 and protrudes into the inside of the wristwatch case 1, a middle-diameter cylindrical section 13*b* that is fitted into the large-diameter hole section 16*b* of the through hole 16, and a large-diameter cylindrical section 13*c* that protrudes outside the wristwatch case 1, as depicted in FIG. 2 to FIG. 4.

The small-diameter cylindrical section 13*a* of the cylindrical member 13 is structured such that a portion to be placed inside the small-diameter hole section 16*a* of the through hole 16 is formed in a rectangular shape and thereby prevents the cylindrical member 13 from rotating in the through hole 16.

Also, a portion of the small-diameter cylindrical section 13*a* of the cylindrical member 13 which protrudes into the inside of the wristwatch case 1 is formed in a cylindrical shape, as depicted in FIG. 2 to FIG. 4.

In this cylindrical portion of the small-diameter cylindrical portion 13*a*, a ring mount groove 17 is provided. On the ring mount groove 17, a stopper ring 18 such as an E ring is mounted.

As a result, the cylindrical member 13 is attached inside the through hole 16 of the wristwatch case 1 with it being prevented from moving outside the wristwatch case 1 by the stopper ring 18.

In the outer circumferential surface of the middle-diameter cylindrical section 13*b* of the cylindrical member 13, a plurality of gasket grooves 19 are provided, as depicted in FIG. 2 to FIG. 4, FIG. 5A and FIG. 5B.

Into these gasket grooves 19, waterproof gaskets 20 are attached which come in pressure-contact with the inner circumferential surface of the large-diameter hole section 16*b* of the through hole 16 of the wristwatch case 1.

The large-diameter cylindrical section 13*c* of the cylindrical member 13 is provided with a flange section 21 that comes in tact with the outer end face of the wristwatch case 1, a plurality of engaging projections 22 projecting in a radial direction, and a groove section 23 adjacent to these engaging projections 22.

In this case, the flange section 21 is provided on the outer circumference of an end of the large-diameter cylindrical section 13*c* of the cylindrical member 13 on the wristwatch case 1 side, as depicted in FIG. 2 to FIG. 4, FIG. 5A and FIG. 5B.

As a result, the flange section 21 is structured to come in contact with the outer end face of the wristwatch case 1 with the stopper ring 18 of the small-diameter cylindrical section 13*a* being in contact with the inner end face of the wristwatch case 1, and thereby regulate the position of the cylindrical member 13 with respect to the wristwatch case 1 in directions in which the cylindrical member 13 is pushed inward and pulled outward.

The groove section 23 is formed such that its depth, that is, the diameter of its bottom is approximately equal to the outer diameter of the middle-diameter cylindrical section 13*b*, as depicted in FIG. 2 to FIG. 4, FIG. 5A and FIG. 5B.

Regarding the plurality of engaging projections 22, three engaging projections 22 are provided at every 120 degrees on outer end portions of the large-diameter cylindrical section 13*c* of the cylindrical member 13.

These engaging projections 22 are each formed such that its length projecting in a radial direction is approximately equal to the depth of the groove section 23.

As a result, these engaging projections 22 each have an outer circumferential end equal in size to the outer circumferential surface of the large-diameter cylindrical section 13*c*.

Figure 6:
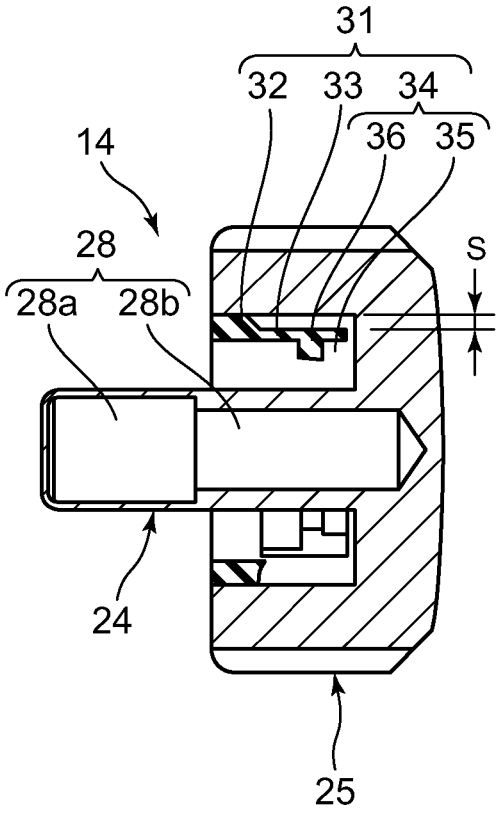
FIG. 6 is an enlarged sectional view depicting the operating member of the switch device depicted in FIG. 2 and a lock member provided therein.

On the other hand, the operating member 14 includes an operation shaft section 24 that is inserted into the cylindrical member 13 and a cap-shaped operation head section 25 provided on the outer end of the operation shaft section 24, as depicted in FIG. 2, FIG. 3 and FIG. 6.

Figure 5A:
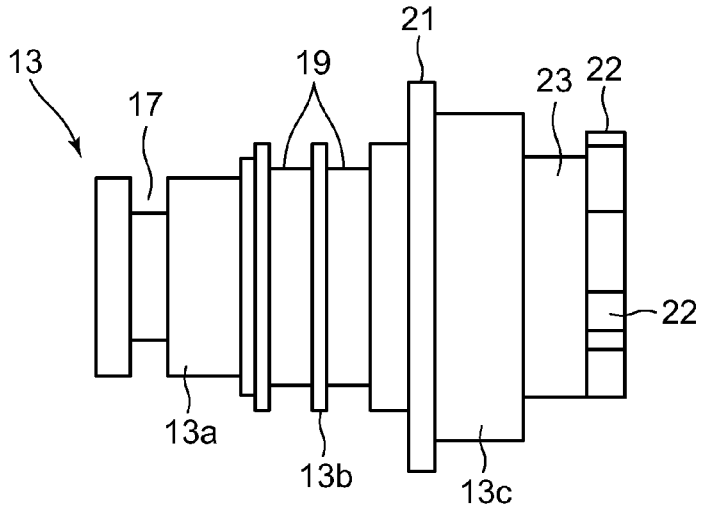
Figure 5B:
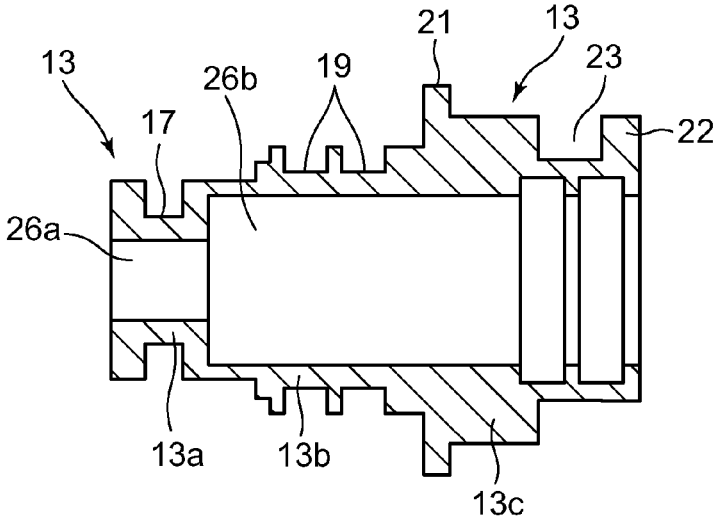

In this case, the cylindrical member 13 has provided therein a small-diameter hole 26*a* provided in the small-diameter cylindrical section 13*a* protruding into the inside of the wristwatch case 1 and a large-diameter hole 26*b* provided through the small-diameter cylindrical section 13*a* to the large-diameter cylindrical section 13*c* inside the through hole 16 of the wristwatch case 1, as depicted in FIG. 5B.

The operation shaft section 24 of the operating member 14 is formed such that its length in the axial direction is approximately equal to the length of the large-diameter hole 26*b* of the cylindrical member 13, as depicted in FIG. 2, FIG. 3 and FIG. 6.

As a result, the operation shaft section 24 is structured such that it is inserted in the large-diameter hole 26*b* of the cylindrical member 13 and the plurality of waterproof rings 27 provided on the inner circumferential surface of the large-diameter hole 26*b* of the cylindrical member 13 come in elastic contact with the inserted outer circumferential surface. In this state, the operation shaft section 24 rotates and slides.

Also, the operation shaft section 24 has provided therein a shaft hole 28 continuously provided between the end portion thereof on the wristwatch case 1 side and a middle portion inside the operation head section 25, as depicted in FIG. 2, FIG. 3 and FIG. 6.

The shaft hole 28 of the operation shaft section 24 is structured to have a rectangular hole section 28*a* in a rectangular shape positioned on the wristwatch case 1 side and a circular hole section 28*b* in a circular shape positioned on the operation head section 25 side, and the circular hole section 28*b* is inscribed in the rectangular hole section 28*b*.

Moreover, the operation shaft section 24 is structured to be coupled to the winding stem 12 by a coupling shaft 30 inserted inside the shaft hole 28, as depicted in FIG. 2 and FIG. 3.

That is, the coupling shaft 30 is structured to be mounted on the outer end of the winding stem 12 and, in this state, inserted into the shaft hole 28 of the operation shaft section 24 in the large-diameter hole 26*b* through the small-diameter hole 26*a* of the cylindrical member 13, whereby the winding stem 12 is coupled to the operation shaft section 24.

In this case, a middle portion of the coupling shaft 30 is provided with a flange section 30*a* and a washer 30*b* which move inside the rectangular hole section 28*a* in the shaft hole 28 of the operation shaft section 24, as depicted in FIG. 2 and FIG. 3.

The washer 30*b*, which is a flat plate with a rectangular outer shape that is the same as that of the rectangular hole section 28*a* of the operation shaft section 24, is structured such that its center portion is mounted on the coupling shaft 30, slides in this state inside the rectangular hole section 28*a* of the operation shaft section 24, and transfers the rotation of the operation shaft section 24 to rotate the coupling shaft 30.

In the shaft hole 28 of the operation shaft section 24, a coil spring 31 is placed, as depicted in FIG. 2 and FIG. 3.

The coil spring 31 is structured to be placed between the flange section 30*a* of the coupling shaft 30 and a depth portion located outside the circular hole 28*b* of the shaft hole 28 (at the right end in FIG. 2), and to press the operation shaft section 24 in a direction where the operation shaft section 24 is pushed from inside the large-diameter hole 26*b* of the cylindrical member 13 toward the outside of the wristwatch case 1.

The operation head section 25 of the operating member 14 has an approximately cap shape as a whole, which is integrally formed on the outer end of the operation shaft section 24, as depicted in FIG. 2, FIG. 3 and FIG. 6.

This operation bead section 25 is formed such that its inner diameter is larger than the outer diameter of the large-diameter cylindrical section 13*c* of the cylindrical member 13 and approximately equal to the outer diameter of the flange section 21 of the cylindrical member 13.

Also, the operation head section 25 is formed such that its inner length in the axial direction is equal to or slightly longer than the length of the large-diameter cylindrical section 13*c* of the cylindrical member 13 in the axial direction.

Inside the operation head section 25, the lock member 15 is fixed, as depicted in FIG. 2, FIG. 3, FIG. 6 and FIG. 7. The lock member 15 includes a ring section 32 that is fitted into the operation head section 25, a plurality of resilient support sections 33 provided on the outer end of the ring section 32, and a plurality of lock sections 34 respectively provided to the plurality of resilient support sections 33.

The ring section 32 has an outer circumferential surface fixed to the inner circumferential surface of the operation head section 25 by press-fitting or bonding so as to be integrated into the operation head section 25.

Also, the ring section 32 is structured such that its inner diameter is slightly larger than the outer diameter of the large-diameter cylindrical section 13*c* of the cylindrical member 13 so as to rotate and slide along the outer circumferential surface of the large-diameter cylindrical section 13*c*, as depicted in FIG. 2, FIG. 3, FIG. 6 and FIG. 7.

The plurality of resilient support sections 33 are each structured to be provided on the outer end face of the ring section 32 (on the upper side in FIG. 7), that is, the outer end face positioned on the side opposite to the wristwatch case 1, projecting along the axial direction of the large-diameter cylindrical section 13*c* of the cylindrical member 13, as depicted in FIG. 2, FIG. 3, FIG. 6 and FIG. 7. In this state, the plurality of resilient support sections 33 are resiliently deformed in a radial direction.

Figure 7:
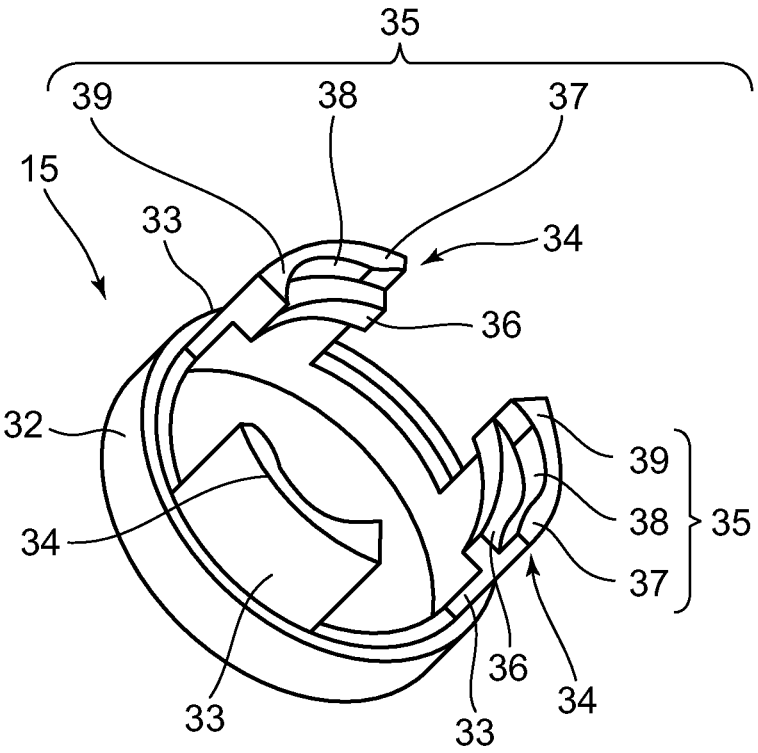
FIG. 7 is an enlarged perspective view of the lock member depicted in FIG. 6.

That is, the plurality of resilient support sections 33 are structured to have a space S between its outer side surface and the inner circumferential surface of the operation head section 25 as depicted in FIG. 6 and FIG. 7. With this space S, the plurality of resilient support sections 33 are resiliently deformed in a radial direction.

Also, the plurality of resilient support sections 33 are provided in three areas on the outer end face of the ring section 32 at every 120 degrees.

Furthermore, the plurality of resilient support sections 33 are structured such that their inner side surfaces rotate and slide along the outer circumferential surface of the large-diameter cylindrical section 13*c* of the cylindrical member 13.

The plurality of lock sections 34 are each provided to the inner surface of each of the plurality of resilient support sections 33, as depicted in FIG. 6 to FIG. 10.

Each of the lock sections 34 includes a rotation restricting section 35 which restricts the rotation of the lock member 15 when the outer end of the engaging projection 22 of the cylindrical member 13 is engaged with the lock member 15, and a slide restricting section 36 which restricts the sliding of the lock member 15 when a side surface of the engaging projection 22, that is, a side surface of the engaging projection 22 on the wristwatch case 1 side (lower surface in FIG. 9) comes in contact with the lock member 15.

The rotation restricting section 35 includes a first projection 37 where the engaging projection 22 overshoots by resiliently deforming the resilient support section 33 when the lock member 15 rotates in one direction (clockwise direction in FIG. 9), an engaging recess 38 with which the engaging projection 22 that has overshot the first projection 37 is engaged, and a second projection 39 which prevents further rotation of the lock member 15 in one direction (clockwise direction) with the engaging projection 22 being engaged with the engaging recess 38, as depicted in FIG. 6 to FIG. 10.

In this case, the first projection 37 of the rotation restricting section 35 is formed in a slightly tilted mountain shape such that its projection length in a radial direction is shorter than a resilient deformation amount of the resilient support section 33, or in other words, the space S that is displaced as the resilient support section 33 is pressed in the radial direction, as depicted in FIG. 7.

As a result, the first projection 37 is structured such that the engaging projection 22 overshoots the first projection 37 while resiliently deforming the resilient support section 33 when it comes in contact with the first projection 37 to move in the rotating direction.

The engaging recess 38 of the rotation restricting section 35 is a recess that is continuous with the first projection 37, and formed in a substantially same shape as that of the engaging projection 22, as depicted in FIG. 7.

As a result, the engaging recess 38 is structured such that the engaging projection 22 is resiliently engaged with the engaging recess 38 when the engaging projection 22 overshoots the first projection 37 and the resilient support section 33 is resiliently returned to its original position.

Also, the second projection 39 of the rotation restricting section 35 is formed in a mountain shape tilted more steeply than that of the first projection 37, and its projection length in a radial direction is longer than the space S which is the displacement length of the resilient support section 33 in the radial direction, as depicted in FIG. 7.

As a result, the second projection 39 is structured such that, even when the engaging projection 22 comes in contact and the resilient support section 33 is resiliently deformed, the tip of the second projection 39 is positioned on a rotation movement locus with respect to the engaging projection 22, whereby the engaging projection 22 cannot overshoot the second projection 39.

The slide restricting section 36, which restricts the sliding of the lock member 15, is provided in an area on the wristwatch case 1 side of the rotation restricting section 35, as depicted in FIG. 7 to FIG. 10.

The slide restricting section 36 is structured such that a side surface of the engaging projection 22 in the axial direction (lower surface in FIG. 9) comes in contact therewith while the engaging projection 22 overshoots the first projection 37 of the rotation restricting section 35 to be engaged with the engaging recess 38.

As a result, the slide restricting section 36 is structured to prevent the lock member 15 from sliding toward the outside of the wristwatch case 1.

The winding stem 12 connected to the operating member 14 is slidably arranged in the timepiece module 8 in the wristwatch case 1, as depicted in FIG. 2 and FIG. 3.

The winding stem 12 is structured not to perform a sliding or switching motion but to keep a normal timepiece mode when the operation head section 25 of the operating member 14 is pushed against the spring force of the coil spring 31 and, in this state, locked by the lock member 15, as depicted in FIG. 2.

Also, the winding stem 12 is structured not to perform a sliding or switching motion but to keep a normal timepiece mode even when the lock on the operation head section 25 of the operating member 14 by the lock member 15 is released and the operation head section 25 is pressed toward the outside of the wristwatch case 1 by the spring force of the coil spring 31, as depicted in FIG. 3.

Moreover, in a state where the lock on the operation head section 25 of the operating member 14 by the lock member 15 has been released and the operation head section 25 has been pressed toward the outside of the wristwatch case 1 by the spring force of the coil spring 31 as depicted in FIG. 3, when the operation head section 25 is further pulled toward the outside of the wristwatch case 1 as indicated by two-dot-chain lines in FIG. 3, the winding stem 12 performs a sliding motion to switch the normal timepiece mode to a time adjustment mode. Then, when the operation head section 25 is rotated in this state, the winding stem 12 is rotated along with this rotation to adjust the time.

Next, the mechanism of this switch device 11 for a wristwatch is described.

Figure 8:
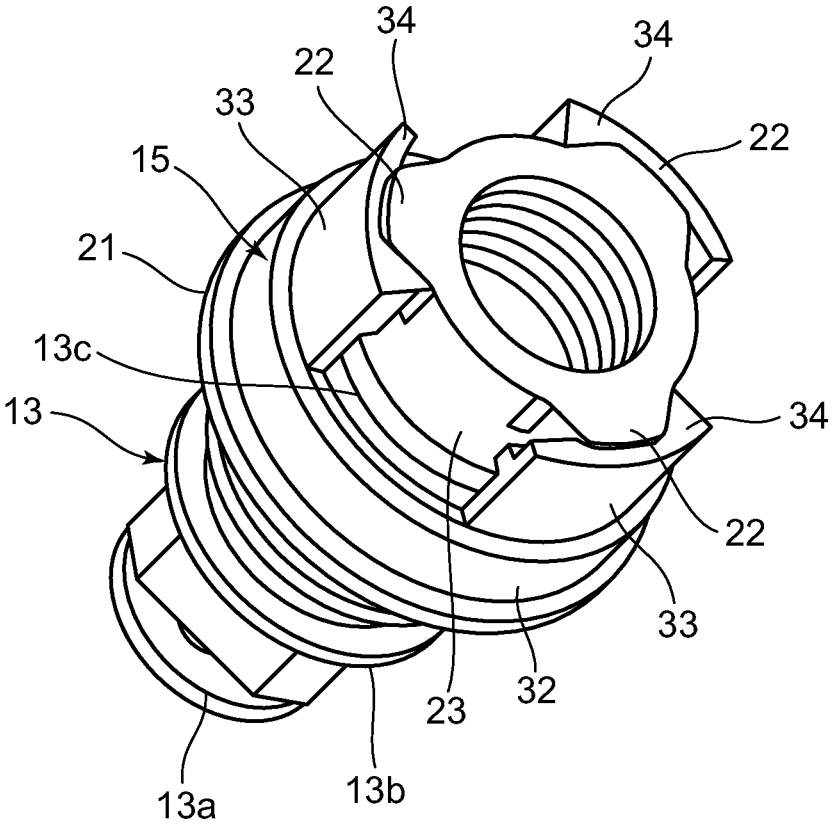
FIG. 8 is an enlarged perspective view of the main section of the switch device depicted in FIG. 2, in which engaging projections of the cylindrical member have been engaged with lock sections of the lock member, and the lock member has been locked thereby.

When the switch device 11 is to be used, the operation head section 25 of the operating member 14 is rotated in the counterclockwise direction in the state depicted in FIG. 2 and FIG. 8.

Then, the lock member 15 is rotated in the counterclockwise direction along with the rotation of the operation head section 25, and the lock on the engaging projection 22 of the cylindrical member 13 by the lock member 15 is released.

Specifically, the engaging projection 22 of the cylindrical member 13 has been engaged with the rotation restricting section 35 of the lock section 34 to restrict the rotation of the lock member 15, and a side surface (lower surface in FIG. 8) of the engaging projection 22 of the cylindrical member 13 has come into contact with the slide restricting section 36 of the lock section 34 to restrict the lock member 15 from sliding, as depicted in FIG. 2 and FIG. 8

Accordingly, the operation head section 25 of the operating member 14 has been locked by the lock member 15 with it being pushed in.

In this state, when the operation head section 25 is rotated counterclockwise by 60 degrees, the lock member 15 is thereby rotated in the same direction by 60 degrees, and the rotation restricting section 35 and the slide restricting section 36 of the lock section 34 are rotated by 60 degrees with respect to the engaging projection 22 of the cylindrical member 13.

Here, the engaging projection 22 relatively moves from the engaging recess 38 of the rotation restricting section 35 toward the first projection 37, and the engaging projection 22 comes in contact with the first projection 37.

Then, each resilient support section 33 is pushed by the engaging projection 22, and resiliently deformed by being bent in a radial direction.

Figure 9:
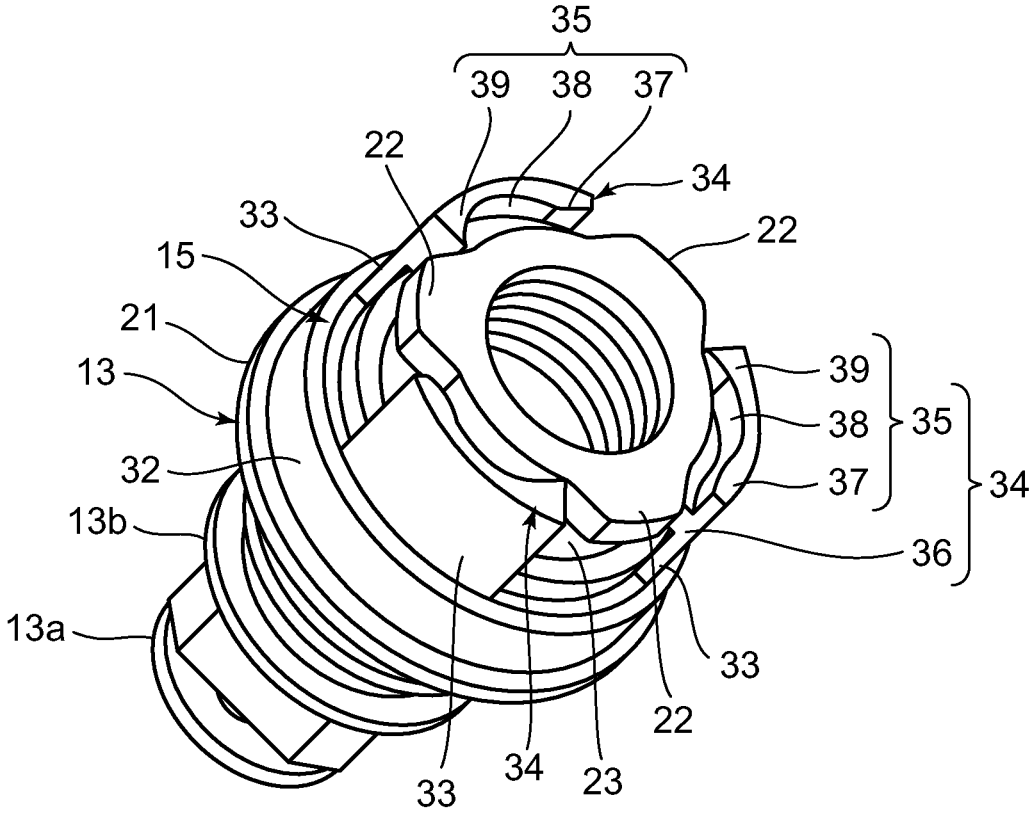
FIG. 9 is an enlarged perspective view of the main section, in which the lock member depicted in FIG. 8 has been rotated and whereby the engaging projections of the cylindrical member have been detached from the lock sections of the lock member so as to release the locking.

As a result, along with the rotation of the lock member 15, each engaging projection 22 relatively overshoots the first projection 37. In addition, a side surface (lower surface in FIG. 8) of the engaging projection 22 rotates and moves along the slide restricting section 36, whereby the engaging projection 22 is disengaged from the rotation restricting section 35 and the slide restricting section 36 and the lock on the engaging projection 22 by the lock member 15 is released, as depicted in FIG. 9.

Figure 10:
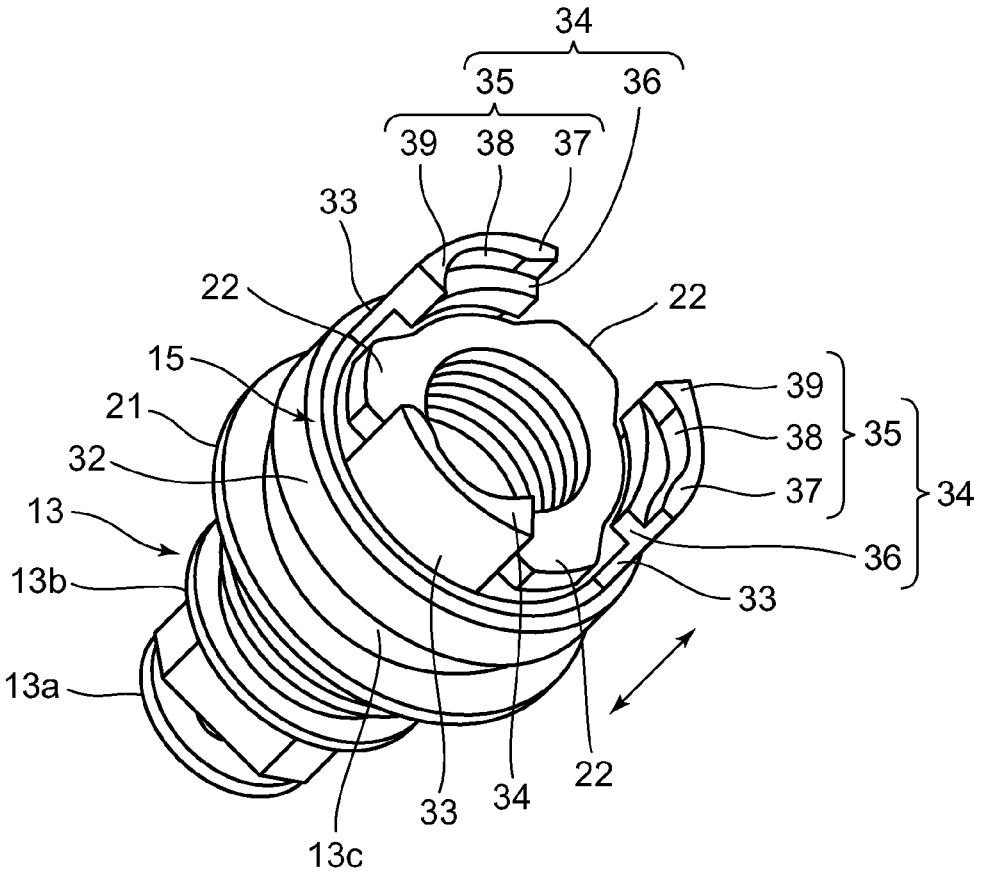
FIG. 10 is an enlarged perspective view of the main section, in which the lock member depicted in FIG. 9 has been pushed outward.

When the lock on the engaging projection 22 of the cylindrical member 13 by the lock member 15 is released as described above, the operation head section 25 is pressed outward with the lock member 15 by the spring force of the coil spring 31 toward the outer side of the wristwatch case 1, as depicted in FIG. 3 and FIG. 10.

Here, the plurality of engaging projections 22 are moved away from the plurality of lock sections 34 of the lock member 15, and positioned between the plurality of resilient support sections 33. Then, in this state, the lock member 15 is pressed outward with the operation head section 25 by the spring force of the coil spring 31.

Also, here, the operation shaft section 24 of the operating member 14 slides inside the cylindrical member 13, but the coupling shaft 30 inserted into the operation shaft section 24 does not slide, as depicted in FIG. 3.

As a result, the winding stem 12 connected to the coupling shaft 30 does not slide, and the normal timepiece mode is maintained.

In this state, the plurality of engaging projections 22 are near the ring section 32 of the lock member 15 and away from the plurality of lock sections 34 by being on the wristwatch case 1 side, as depicted in FIG. 10. Therefore, the lock member 15 is in a rotatable state.

Thus, even if the operation head section 25 is rotated to rotate the winding stem 12, no switch operation is performed.

Then, in this state, when the operation head section 25 is further pulled outward as indicated in FIG. 3 by two-dot-chain lines, the coupling shaft 30 is moved by the operation shaft section 24 toward the outside of the wristwatch case 1, and the winding stem 12 is pulled outward along with the movement of the coupling shaft 30.

As a result, the current mode of the timepiece module 6 is switched to the time adjustment mode.

In this state, when the operation head section 25 is rotated, the winding stem 12 is rotated along with this rotation, and time adjustment is performed based on the rotation of the winding stem 12.

On the other hand, when the switch device 11 is not to be used, the operating member 14 is first pushed inward together with the lock member 15.

Here, the operation head section 25 compresses the coil spring 31 in the operation shaft section 24 to move the coupling shaft 30 to the wristwatch case 1 side, and thereby presses the winding stem 12 inward, as depicted in FIG. 3.

This causes the current mode of timepiece module 6 to be switched from the time adjustment mode to the normal timepiece mode.

In this state, the operating member 14 is further pushed inward together with the lock member 15.

Here, when each engaging projection 22 of the cylindrical member 13 comes in contact with the lock section 34 of the lock member 15 and cannot press the operation head section 25 inward, the operation head section 25 is rotated by 60 degrees to cause the lock section 34 of the lock member 15 to be separated away from the engaging projection 22 of the cylindrical member 13, as depicted in FIG. 10.

Then, when the operation head section 25 is moved together with the lock member 15 to the wristwatch case 1 side, the ring section 32 of the lock member 15 comes in contact with the flange section 21 of the cylindrical member 13, as depicted in FIG. 2 and FIG. 9.

In this state, when the operation head section 25 is rotated in the clockwise direction by 60 degrees, each lock section 34 of the lock member 15 is moved toward the engaging projection 22 of the cylindrical member 13 to cause the engaging projection 22 to be engaged with the rotation restricting section 35 and the slide restricting section 36 of the lock section 34 for positional regulation.

That is, here, each of the plurality of engaging projections 22 comes in contact with each first projection 37 of the plurality of rotation restricting sections 35, bends each resilient support section 33 in a radial direction, and overshoots each first projection 37. In addition, a side surface (lower surface in FIG. 9) of each of the plurality of engaging projections 22 rotates and moves with it being in contact with the slide restricting section 36.

Then, when the plurality of engaging projections 22 overshoot the respective first projections 37, the plurality of engaging projections 22 are engaged with the respective engaging recesses 38 of the plurality of rotation restricting sections 35.

Thus, the positions of the plurality of engaging projections 22 in a rotating direction are regulated by the plurality of rotation restricting sections 35, and the positions of the plurality of engaging projections 22 in a sliding direction are regulated by the plurality of slide restricting sections 36, whereby the lock member 15 is locked to the cylindrical member 13.

In this state, even if the operation head section 25 is rotated in the clockwise direction, because the plurality of engaging projections 22 come in contact with the respective second projections 39 of the plurality of rotation restricting sections 35 and the lock member 15 is not rotated, the operation head section 25 is not rotated.

That is, when the operation head section 25 is rotated clockwise and the plurality of engaging projections 22 come in contact with the respective second projections 39 of the plurality of rotation restricting sections 35, even if each resilient support section 33 is bent in a radial direction and come in contact with the inner surface of the operation head section 25, the tips of the respective second projections 39 are positioned on the rotation movement locus with respect to the respective engaging projections 22.

Therefore, the plurality of engaging projections 22 do not overshoot the plurality of second projections 39.

As a result, the operation head section 25 is locked by the lock member 15 and not rotated in the clockwise direction.

As described above, this switch device 11 for a wristwatch includes the cylindrical member 13 fitted into the through hole 16 of the wristwatch case 1, the operating member 14 having the operation shaft section 24 to be inserted into the cylindrical member 13 and the operation head section 25 at the outer end, and the lock member 15 that is fixed inside the operation head section 25 and slides and rotates together with the operation head section 25 along the outer circumference of the cylindrical member 13. The cylindrical member 13 is provided with the engaging projections 22, and the lock member 15 includes the resilient support sections 33 which is provided with the space S with respect to the inner circumferential surface of the operation head section 25 and resiliently deformed in a radial direction and the lock sections 34 with which the engaging projections 22 are resiliently engaged. As a result, a lock releasing operation can be easily performed, and inadvertent rotation of the operating member 14 in the locked state can be prevented.

That is, in the switch device 11, when the operating member 14 is pushed and rotated so as to be locked, the engaging projections 22 of the cylindrical member 13 resiliently deforms the resilient support sections 33 of the lock member 15, whereby the lock sections 34 can lock the engaging projections 22 by the resilient force of the resilient support sections 33. As a result, inadvertent rotation of the operating member 14 in the locked state can be prevented.

Also, when the lock on the operating member 14 is to be released, only by the operating member 14 being rotated against the resilient restriction force of the lock section 34 with respect to the engaging projection 22, the lock on the engaging projection 22 by the lock section 34 can be easily released.

In this case, each lock section 34 of the operating member 14 includes the rotation restricting section 35 with which the engaging projection 22 of the cylindrical member 13 is engaged to restrict the rotation of the lock member 15 and the slide restricting section 36 with which the engaging projection 22 comes in contact to restrict the sliding of the lock member 15. Therefore, upon resiliently deforming the resilient support section 33 of the lock member 15, the engaging projection 22 can restrict the rotation of the lock member 15 by being engaged with the rotation restricting section 35, and can restrict the sliding of the lock member 15 by coming in contact with the slide restricting section 36, whereby the operating member 14 can be reliably and favorably locked.

Also, the rotation restricting section 35 includes the first projection 37 where the engaging projection 22 of the cylindrical member 13 overshoots by resiliently deforming the resilient support section 33 when the lock member 15 is rotated in one direction such as a clockwise direction, the engaging recess 38 where the engaging projection 22 that has overshot the first projection 37 is engaged, and the second projection 39 which prevents further rotation of the lock member 15 in the one direction with the engaging projection 22 being engaged with the engaging recess 38. Therefore, the engaging projection 22 of the cylindrical member 13 can be reliably and favorably locked by the resilient force of the resilient support section 33.

That is, when the engaging projection 22 bends the resilient support section 33 in a radial direction and overshoots the first projection 37, the rotation restricting section 35 engages each engaging projection 22 with the engaging recess 38, and thereby regulates the position of the engaging projection 22 in the rotating direction.

Also, in this state, when the operation head section 25 is rotated in the clockwise direction, even though each engaging projection 22 comes in contact with the second projection 39 and bends the resilient support section 33 in the radial direction, the engaging projection 22 does not overshoot the second projection 39 by the tip of the second projection 39 protruding into the rotation movement locus with respect to the engaging projection 22.

Therefore, the operation head section 25 can be reliably prevented from rotating in the clockwise direction, whereby the operation head section 25 can be reliably locked.

In this case, three engaging projections 22 are provided at the outer end of the cylindrical member 13 at every 120 degrees, and three resilient support sections 33 are provided at the outer end of the lock member 15 at every 120 degrees. As a result, every time the operation head section 25 is rotated by 60 degrees, the plurality of engaging projections 22 can be each reliably and favorably engaged or disengaged by the lock section 34 provided to each of the plurality of resilient support sections 33, whereby the operability of the operation head section 25 can be improved.

Second Embodiment

Next, a second embodiment in which a switch device of the present invention has been applied in a wristwatch is described with reference to FIG. 11 to FIG. 15.

Note that sections identical to those in the first embodiment depicted in FIG. 1 to FIG. 10 are provided with the same reference numerals simplification of description.

Figure 11:
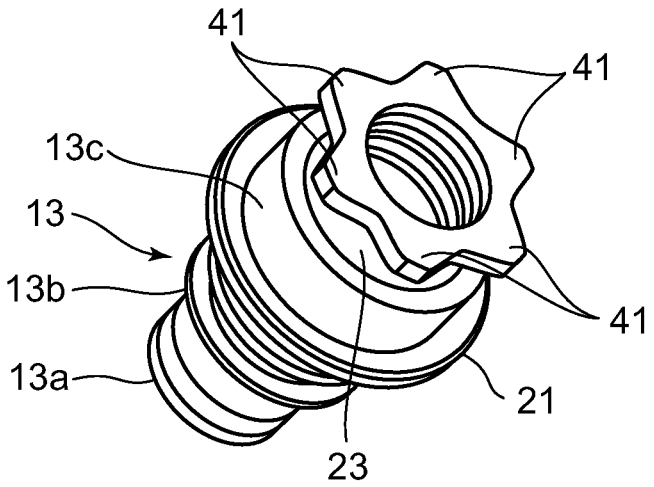
FIG. 11 is an enlarged perspective view of a cylindrical member of a switch device according to a second embodiment of the present invention which has been applied in a wristwatch.
Figure 12:
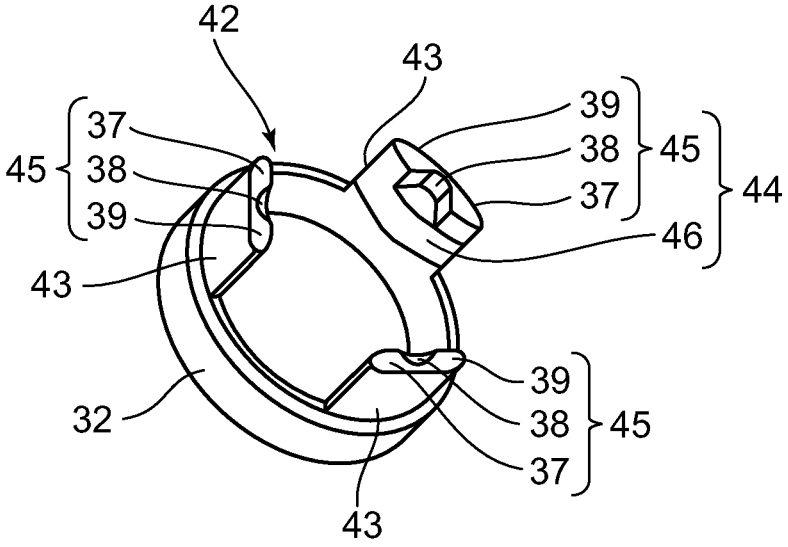
FIG. 12 is an enlarged perspective view of a lock member with which engaging projections of the cylindrical member depicted in FIG. 11 are engaged.
Figure 13:
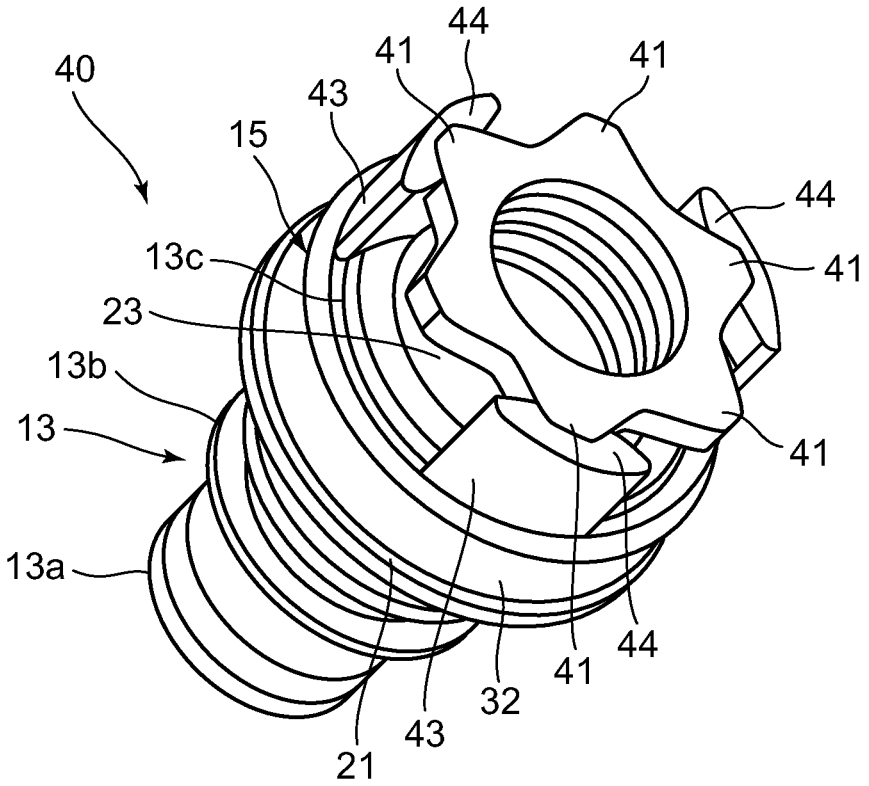
FIG. 13 is an enlarged perspective view of the main section of the switch device depicted in FIG. 11 and FIG. 12, in which the engaging projections of the cylindrical member have been engaged with lock sections of the lock member, and the lock member has been locked thereby.
Figure 14:
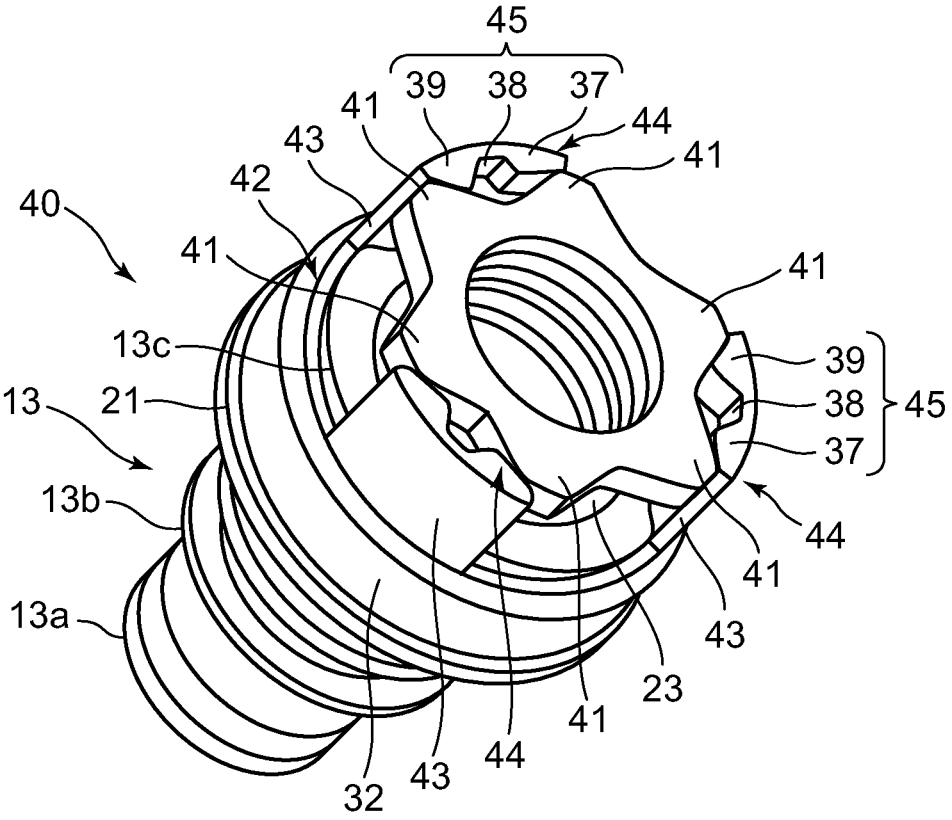
FIG. 14 is an enlarged perspective view of the main section, in which the lock member depicted in FIG. 13 has been rotated and whereby the engaging projections of the cylindrical member have been detached from the lock sections of the lock member so as to release the locking.
Figure 15:
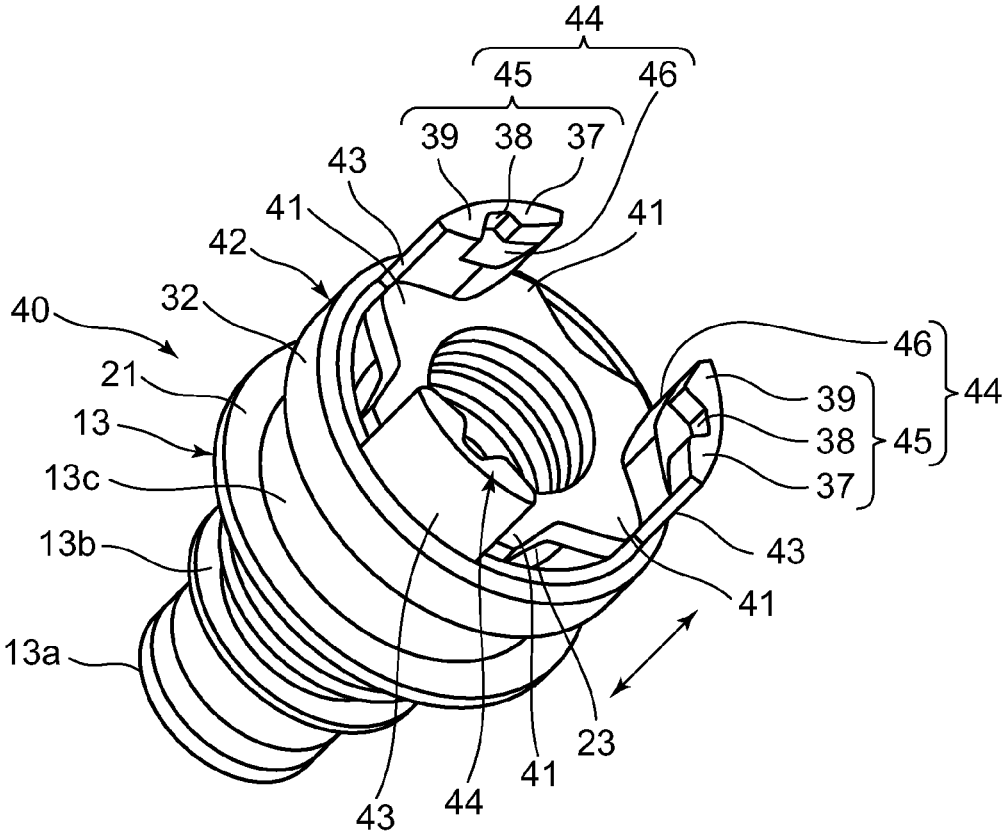
FIG. 15 is an enlarged perspective view of the main section, in which the lock member depicted in FIG. 14 has been pushed outward.

The structure of this switch device 40 for a wristwatch is substantially the same as that of the first embodiment except that engaging projections 41 and a lock member 42 of its cylindrical member 13 are different from those of the first embodiment, as depicted in FIG. 11 and FIG. 12.

As with the first embodiment, the switch device 40 is provided on the side portion of the wristwatch case 1 on the three o'clock side.

Also, the switch device 40 is to switch the mode of the timepiece module 8, adjust the time, and the like, and includes the winding stem 12, the cylindrical member 13, the operating member 14, and the lock member 15, as with the first embodiment.

The engaging projections 41 of the cylindrical member 13 are provided on the outer end of the large-diameter cylindrical section 13*c* of the cylindrical member 13, that is, the outer end on the outside of the wristwatch case 1 so as to project in a radial direction, as depicted in FIG. 11.

Regarding the engaging projections 41, six engaging projections 41 are provided at every 60 degrees at the outer end of the large-diameter cylindrical section 13*c* of the cylindrical member 13.

In this case, the large-diameter cylindrical section 13*c* of the cylindrical member 13 is provided with the groove section 23 adjacent to the plurality of engaging projections 41, as depicted in FIG. 11.

As with the first embodiment, the groove section 23 is formed such that its depth, that is, the diameter of its bottom is approximately equal to the outer diameter of the middle-diameter cylindrical section 13*b*.

As a result, the plurality of engaging projections 41 are formed such that its length projecting in a radial direction is equal to the depth of the groove section 23.

Accordingly, these engaging projections 41 are formed such that each outer end is equal to the outer circumferential surface of the large-diameter cylindrical section 13*c*.

On the other hand, the lock member 15 includes the ring section 32 that is fitted into the operation head section 25 of the operating member 14, a plurality of resilient support sections 43 provided at an end of the ring section 32, and a plurality of lock sections 44 respectively provided to the inner surfaces of the plurality of resilient support sections 43, as depicted in FIG. 12.

In this case, three resilient support sections 43 are provided at the outer end of the ring section 32 at every 120 degrees, as in the case of the first embodiment.

As with the first embodiment, the plurality of lock sections 44 includes a rotation restricting section 45 which restricts the rotation of the lock member 15 when the outer end of the engaging projection 41 of the cylindrical member 13 is engaged with the lock member 15, and a slide restricting section 46 which restricts the sliding of the lock member 15 when a side surface of the engaging projection 41, that is, the side surface of the engaging projection 41 on the wristwatch case 1 side comes in contact with the lock member 15.

As in the case of the first embodiment, the rotation restricting section 45 includes the first projection 37 where the engaging projection 41 overshoots by resiliently deforming the resilient support section 33 when the lock member 15 is rotated in one direction (clockwise direction in FIG. 14), the engaging recess 38 with which the engaging projection 41 that has overshot the first projection 37 is engaged, and the second projection 39 which prevents further rotation of the lock member 15 in the one direction (clockwise direction) with the engaging projection 41 being engaged with the engaging recess 38.

The slide restricting section 46 is formed in an approximately triangular prism shape identical to the shape of a space between the plurality of engaging projections 41 of the cylindrical member 13, as depicted in FIG. 12 to FIG. 15.

Accordingly, the plurality of lock sections 44 are each formed in an approximately triangular shape as a whole which is identical to the shape of the space between the plurality of engaging projections 41.

Also, the plurality of resilient support sections 43 are formed such that its length in a circumferential direction is approximately equal to a length between the tips of the plurality of engaging projections 41.

With this switch device 40 for a wristwatch, operations and effects similar to those of the first embodiment can be achieved. In addition, since six engaging projections 41 are provided on the outer end of the cylindrical member 13 at every 60 degrees and three resilient support sections 33 are provided at the outer end of the lock member 15 at every 120 degrees, the plurality of engaging projections 41 can be efficiently engaged or disengaged by the respective lock sections 34 provided to the plurality of resilient support sections 33 every time the operation head section 25 is rotated by 30 degrees, whereby the operability of the operation head section 25 can be improved more than the first embodiment.

In each of the above-described first and second embodiments, three or six engaging projections 22 (41) are provided at the outer end of the cylindrical member 3 at every 120 or 60 degrees, respectively. However, the present invention is not limited thereto. For example, only one engaging projection 22 (41) may be provided, or two engaging projections 22 (41) may be provided at every 180 degrees. Alternatively, four or five engaging projections 22 (41) may be provided at every 90 or 72 degrees, respectively.

Also, in each of the above-described first and second embodiments, three resilient support sections 33 are provided at every 120 degrees on the outer end of the lock member 15. However, the present invention is not limited thereto. For example, only one resilient support section 33 may be provided, two resilient support sections 33 may be provided at every 180 degrees, four resilient support sections 33 may be provided at every 90 degrees, five resilient support sections 33 may be provided at every 72 degrees, and six resilient support sections 33 may be provided at every 60 degrees.

Moreover, in each of the above-described first and second embodiments, the present invention has been applied in a wristwatch. However, the present invention is not necessarily required to be applied in a wristwatch, and can be widely applied to various timepieces, such as a travel watch, an alarm clock, a table clock, and a wall clock.

While the present invention has been described with reference to the preferred embodiments, it is intended that the invention be not limited by any of the details of the description therein but includes all the embodiments which fall within the scope of the appended claims.

What is claimed is:

1. A switch device comprising:

a case having a through hole;

a cylindrical member fitted into the through hole of the case;

an operating member having a shaft section to be inserted into the cylindrical member and an operating section on an outer end; and a lock member which is fixed inside the operating section of the operating member and slides and rotates together with the operating section along an outer circumference of the cylindrical member, wherein the cylindrical member is provided with an engaging projection projecting toward an inner circumferential surface of the lock member, and wherein the lock member includes a resilient support section which has a space with respect to an inner circumferential surface of the operating section and which is resiliently deformable in a radial direction, and a lock section which is provided to the resilient support section and with which the engaging projection is resiliently engaged when the operating section is pushed inward and rotated.

2. The switch device according to claim 1, wherein the lock section includes a rotation restricting section which restricts rotation of the lock member by being engaged with the engaging projection, and a slide restricting section which restricts sliding of the lock member by coming in contact with the engaging projection.

3. The switch device according to claim 2, wherein the rotation restricting section includes a first projection where the engaging projection overshoots by resiliently deforming the resilient support section when the lock member is rotated in one direction, an engaging recess with which the engaging projection that has overshot the first projection is engaged, and a second projection which prevents further rotation of the lock member in the one direction with the engaging projection being engaged with the engaging recess.

4. The switch device according to claim 3, wherein the first projection is formed such that a projecting length in a radial direction is shorter than the space, and the second projection is formed such that a projecting length in a radial direction is longer than the space.

5. The switch device according to claim 1, wherein three engaging projections are provided on an outer end of the cylindrical member at every 120 degrees, and three resilient support sections are provided on an outer end of the lock member at every 120 degrees.

6. The switch device according to claim 1, wherein six engaging projections are provided on an outer end of the cylindrical member at every 60 degrees, and three resilient support sections are provided on an outer end of the lock member at every 120 degrees.

7. A timepiece comprising:

a timepiece module;

a timepiece case in which the timepiece module has been arranged; and a switch device placed in the timepiece case for operating the timepiece module, wherein the switch device includes a case having a through hole, a cylindrical member fitted into the through hole of the case, an operating member having a shaft section to be inserted into the cylindrical member and an operating section on an outer end, and a lock member which is fixed inside the operating section of the operating member and slides and rotates together with the operating section along an outer circumference of the cylindrical member, wherein the cylindrical member is provided with an engaging projection projecting toward an inner circumferential surface of the lock member, and wherein the lock member includes a resilient support section which has a space with respect to an inner circumferential surface of the operating section and which is resiliently deformable in a radial direction, and a lock section which is provided to the resilient support section and with which the engaging projection is resiliently engaged when the operating section is pushed inward and rotated.

* * * * *